United States Patent [19]

Hartel

[11] 4,307,993

[45] Dec. 29, 1981

[54] AIR-COOLED CYLINDER WITH PISTON RING LABYRINTH

[75] Inventor: Edward O. Hartel, Orange, Conn.

[73] Assignee: Avco Corporation, Stratford, Conn.

[21] Appl. No.: 124,374

[22] Filed: Feb. 25, 1980

[51] Int. Cl.[3] ..... F01D 11/00; F01D 25/08

[52] U.S. Cl. ..... 415/116; 415/117; 415/136; 415/178

[58] Field of Search ..... 415/178, 116, 117, 172 A, 415/134, 135, 136, 170 R, 174

[56] References Cited

U.S. PATENT DOCUMENTS

| | | | |
|---|---|---|---|
| 3,391,904 | 7/1968 | Albert | 415/116 |
| 3,825,365 | 7/1974 | Peng | 415/116 |
| 3,966,356 | 6/1976 | Irwin | 415/174 |

FOREIGN PATENT DOCUMENTS

| | | | |
|---|---|---|---|
| 274476 | 5/1914 | Fed. Rep. of Germany | 415/116 |
| 272918 | 5/1951 | Switzerland | 415/116 |

*Primary Examiner*—Douglas Hart
*Attorney, Agent, or Firm*—Ralph D. Gelling

[57] ABSTRACT

A turbine cylinder is in contact at its outer surface with split rings which are held in place in annular slots in a cylindrically extending ring holder. The rings, while remaining in contact with the outer surface of the cylinder, are allowed to expand and contract within their respective slots. Notches are constructed at the inner circumference of the rings to form a labyrinth type cooling passage in conjunction with the outer surface of the turbine cylinder.

6 Claims, 3 Drawing Figures

*Fig.1.*
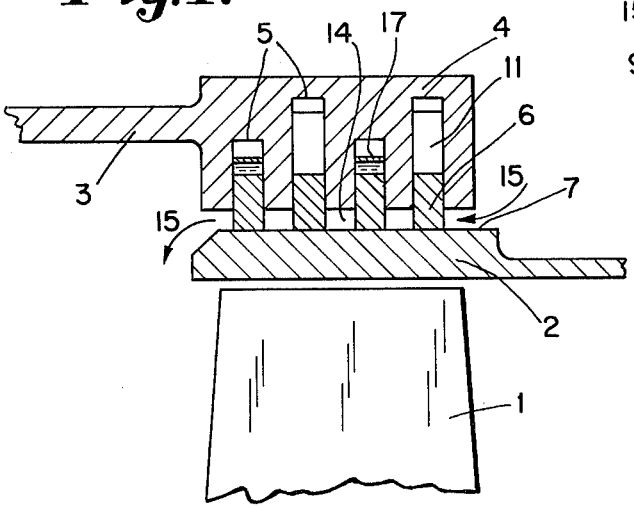
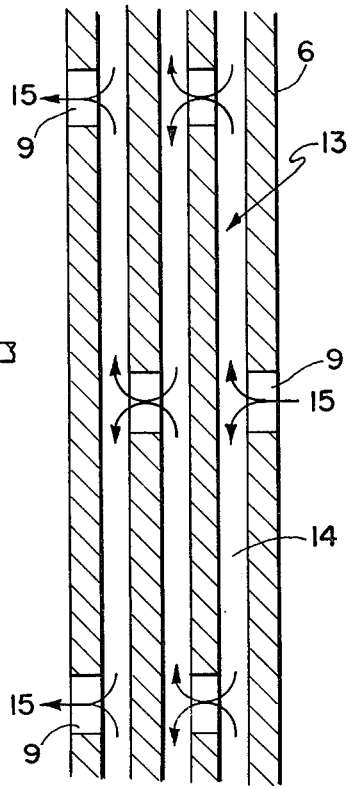
*Fig.2.*
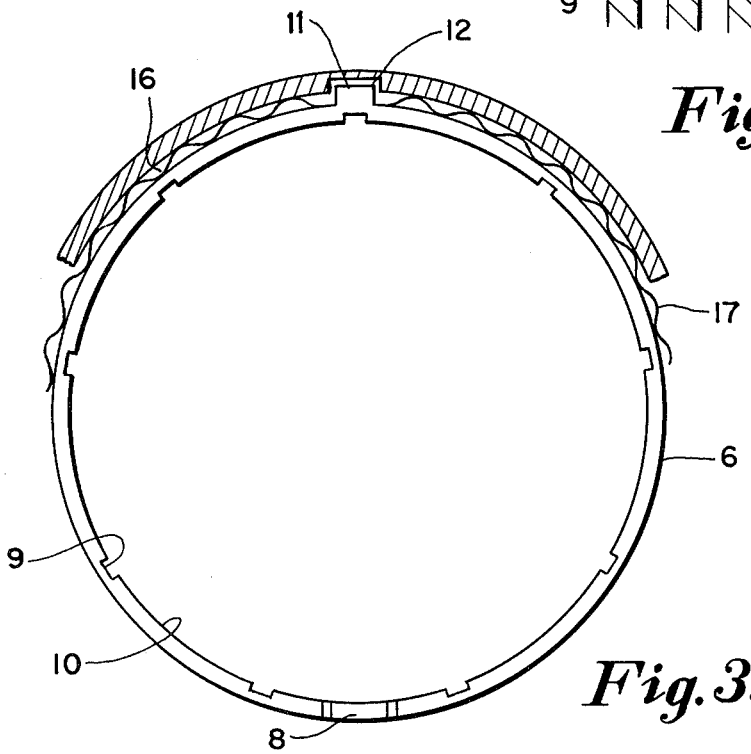
*Fig.3.*

AIR-COOLED CYLINDER WITH PISTON RING LABYRINTH

BACKGROUND OF THE INVENTION

One of the most difficult areas to design in a gas turbine engine is the interface between the turbine blade and its surrounding shroud. It is required, for maximum efficiency, that the clearance between the blade tip and the shroud be as close as possible. This is a distinct problem in that these cooperating parts of the engine have different thermal and centrifugal expansion characteristics and if tip clearance is not maintained at least at a minimum level, rubbing could occur with a potentially destructive result. On the other hand, if a large gap is present a significant loss of power may occur. Cooling is generally necessary to further minimize the differential transient growth rates, for example, between radial growth of the shroud and thermal and centrifugal growth of the blades.

It is, therefore, necessary to design a shroud assembly which can accommodate the differential thermal growth, but which can maintain a tip clearance at a relatively constant and minimum level.

It is, therefore, the purpose of this invention to provide a structure which provides cooling to the turbine shroud and can react dynamically as differential thermal expansion occurs to maintain a minimum tip clearance.

SUMMARY OF THE INVENTION

An air cooled turbine cylinder assembly is constructed having a floating arrangement which allows unrestrained movement between the parts of the assembly. This assembly consists of a cylindrical ring holder constructed with a plurality of annular slots at its radially innermost surface. These slots accomodate a series of axially spaced split rings which extend radially inward to engage the outer surface of the turbine shroud. The rings are allowed to slide radially within the slots when thermal growth occurs, which provide the floating aspect of the design. An optional spring device may be employed to maintain the ring in contact with the outer surface of the shroud. The inner circumference of each ring is notched to allow the entrance of cooling air into the annular passage formed by the axial spacing of the slots. By staggering the position of each ring, a labyrinth type cooling passage is formed in conjunction with the outer surface of the turbine shroud.

DESCRIPTION OF THE DRAWING

This invention is described in more detail below with reference to the drawing in which:

FIG. 1 is a schematic representation of the turbine shroud assembly of this invention;

FIG. 2 illustrates the labyrinth cooling passage configuration; and

FIG. 3 is a cross-sectional view showing the ring mounted in the ring holder.

DESCRIPTION OF THE PREFERRED EMBODIMENT

The tip clearance area of the turbine section of a gas turbine engine is shown in FIG. 1 as it relates to this invention. The major elements consist of turbine blade 1, inner cylindrical shroud 2, and outer cylindrical shroud 3. The blade 1 is mounted for rotation on the turbine shaft (not shown), while shrouds 2 and 3 are fixed to appropriate engine structure. In modular type engines it is recommended that the shrouds 2 and 3 be fixed to different modules. For example, the forward portion of outer shroud 3 is fixed to the gas producer module and the rear portion of inner shroud 2 is fixed to the power turbine module. This can provide an axial freedom of movement between the shrouds.

Outer shroud 3 includes a cylindrical ring holder 4 having several annular slots 5 axially spaced on its inner surface.

The ring holder 4 and shroud 2 are separated by split rings 6 which are mounted for radial sliding motion in slots 5. The rings 6 extend radially inward to engage the outer surface 7 of shroud 2 and contact the shroud 2 in a manner which accommodates the dynamics of this assembly during thermal growth. The axial spacing of the slots creates a channel 14 between each ring in conjunction with surface 7.

As best shown in FIG. 3, ring 6 is split at 8 to allow expansion and contraction with the thermal loading which occurs during engine operation. An optional spring device 17 may be installed in the residual space 16 surrounding rings 6 in slots 5 to bias the ring 6 radially inward. The purpose of the spring device 17 is to assure contact of the ring 6 with surface 7 of shroud 2. The rings 6 are also constructed with notches 9 on the inner surface 10 which forms the interface with surface 7 of shroud 2. The notches communicate with channels 14 between rings 6 to form a labyrinth chamber 13 for cooling air 15 as shown in FIG. 2.

Cooling air 15 may be compressor bleed air or ambient air forced forward through the labyrinth to cool surface 7. As best seen in FIG. 1, by exhausting the air forward of shroud 2, film cooling of its inner surface can be achieved.

Each of the rings 6 may be constructed identically and include an index tab 11 extending from the outer circumference of ring 6. A positioning hole 12 is constructed in the ring holder adjacent slot 5 to receive tab 11. The positioning holes 12 are circumferentially spaced about the annular slots 5 so that the rings 6 are angularly displaced from each other thereby offsetting the relative position of the notches to form the labyrinth cooling chamber 13 as shown in FIG. 2.

In this manner a very simple air cooled turbine shroud assembly is constructed which provides the flexibility needed to accommodate the movement caused by the thermal characteristics of the system. Cooling is accomplished with a minimum of air flow because of the high flow per unit area created in the circumferential passages between the rings.

I claim:

1. In a gas turbine engine a turbine blade shroud assembly comprising:

an inner shroud member mounted on the engine structure and extending into the turbine blade clearance area to surround the turbine blades;

an outer shroud member fixed to the engine structure and surrounding the inner shroud member at a radial distance therefrom; said outer shroud member having a plurality of radially extending slots constructed at axially spaced intervals in its inner surface; and a plurality of split rings mounted for sliding radial motion in the annular slots; said rings extending radially inward to engage the inner shroud member; thereby forming annular passages between the axially spaced ring and the inner shroud member, said rings having circumferentially spaced notches on their inner surface to communicate between the annular passages.

2. In a gas turbine engine, a turbine blade shroud assembly as described in claim 1 further comprising a source of pressurized cooling air communicating with the annular passages between the axially spaced rings through the notches.

3. In a gas turbine engine, a turbine blade shroud assembly as described in claim 2 wherein the cooling air is exhausted forward around the edge of the inner shroud to film cool the inner surface of said inner shroud.

4. In a gas turbine engine, a turbine blade shroud assembly as described in claim 1 wherein the split rings are constructed identically and include an index tab extending radially outward from its circumference and the slots are constructed with a positioning hole to receive the index tab, said holes in each slot being spaced about the circumference of the slot relative to the adjacent slot in order to angularly offset the notches in the rings and form a labyrinth flow path for the cooling air.

5. In a gas turbine engine, a turbine blade shroud assembly as described in claim 1 further comprising a spring member mounted in the radially extending slots radially outward from the split rings to bias said rings in the radially inward direction.

6. In a gas turbine engine, a turbine blade shroud assembly as described in claim 1 wherein the inner and outer shroud members are mounted to separate portions of the engine structure in order to allow relative movement between said shroud members in the axial direction.

* * * * *